US012709900B1

(12) United States Patent
Mann et al.

(10) Patent No.: US 12,709,900 B1
(45) Date of Patent: Aug. 18, 2026

(54) APPARATUS FOR PLACEMENT OF MATERIALS ON A ROOF

(71) Applicant: CONSOLIDATED ELECTRICAL DISTRIBUTORS, INC., Irving, TX (US)

(72) Inventors: Steve Mann, Mesa, AZ (US); Juan Barros, Guadalupe, AZ (US); Jose Lopez, Guadalupe, AZ (US); Lance Carter, Phoenix, AZ (US); Brian Chavarria, Phoenix, AZ (US)

(73) Assignee: CONSOLIDATED ELECTRICAL DISTRIBUTORS, INC.

( * ) Notice: Subject to any disclaimer, the term of this patent is extended or adjusted under 35 U.S.C. 154(b) by 171 days.

(21) Appl. No.: 18/104,684

(22) Filed: Feb. 1, 2023

Related U.S. Application Data

(60) Provisional application No. 63/308,856, filed on Feb. 10, 2022.

(51) Int. Cl.
*E04D 15/07* (2006.01)
*E04G 3/26* (2006.01)
*E04G 5/06* (2006.01)

(52) U.S. Cl.
CPC ..... *E04D 15/07* (2013.01); *E04G 3/26* (2013.01); *E04G 3/265* (2013.01); *E04G 2005/068* (2013.01)

(58) Field of Classification Search
CPC ..... E04G 3/26; E04G 3/265; E04G 2005/068; E04D 15/07
See application file for complete search history.

(56) References Cited

U.S. PATENT DOCUMENTS 474,800 A * 5/1892 Thorsen ..... F16M 13/02 248/237
643,845 A * 2/1900 Kuhn ..... E04G 3/26 248/237

(Continued)

FOREIGN PATENT DOCUMENTS

AU 2015100513 A4 5/2015
CH 395503 A * 7/1965 ..... E04G 3/26

(Continued)

OTHER PUBLICATIONS

"Johnny Jack for Steel Shingles, Tile, & Slate", retrieved on Aug. 2, 2023 from https://www.stortz.com/product/johnny-jack-for-steel-shingles-tile-slate/.

*Primary Examiner* — Taylor Morris
(74) *Attorney, Agent, or Firm* — Womble Bond Dickinson (US) LLP

(57) ABSTRACT

Apparatus for use in placing supply materials on a roof includes one or more racks, each of which includes a plurality of rack members. Each of the rack members includes an elongated support member configured to be placed on one side of the roof, as well as an elongated retaining member extending generally upwardly from the support member. Each of the racks includes a connector for removably connecting its corresponding rack members to each other and is placed over a ridge of the roof such that each of the rack members is placed on each side of the roof. Each of the connectors can be removed or detached from the rack members of a corresponding one of the racks and be replaced with a replacement connector having a size different from that of the connector so as to accommodate differently sized supply materials.

15 Claims, 2 Drawing Sheets

(56) References Cited

U.S. PATENT DOCUMENTS 673,065 A 4/1901 Scott
674,170 A * 5/1901 Kuhn ..... E04G 3/26 248/237
1,423,998 A * 7/1922 Camp ..... E04G 3/34 182/187
1,650,324 A * 11/1927 Campbell ..... E04G 3/265 182/147
1,722,762 A * 7/1929 Othick ..... E04G 3/26 248/237
2,999,290 A * 9/1961 Giles ..... E06C 7/50 248/237
3,447,631 A 6/1969 Smith
4,103,871 A * 8/1978 Patterson, III ..... B65D 90/048 254/266
4,531,613 A 7/1985 Keigher
4,854,419 A * 8/1989 Lyras ..... E04G 3/30 182/138
5,143,170 A * 9/1992 Hunt ..... E04G 21/3295 248/237
5,193,773 A 3/1993 Middleton
5,282,597 A * 2/1994 Babcock ..... E04D 13/12 248/237
5,287,944 A 2/1994 Woodyard
5,320,194 A 6/1994 Bredijk
5,379,859 A * 1/1995 Pigman ..... E04G 3/265 248/237
5,474,271 A 12/1995 Raymond
5,513,826 A 5/1996 Lebaron
5,730,407 A * 3/1998 Ostrobrod ..... A62B 35/0043 248/237
5,862,880 A 1/1999 Nelson et al.
6,098,746 A * 8/2000 Castaneda ..... E04G 21/3214 182/45
6,167,987 B1 1/2001 Jensen
6,220,390 B1 4/2001 Pike
6,269,905 B1 8/2001 Smith
8,505,685 B1 * 8/2013 Rayfield ..... E04G 5/041 52/749.12
8,596,414 B1 * 12/2013 Lown ..... E04G 3/28 182/45
8,714,305 B2 * 5/2014 Fontaine ..... E04G 3/265 182/45
9,539,447 B2 * 1/2017 Norris ..... A62B 35/0025
10,640,993 B2 * 5/2020 Apostolopoulos ..... E04G 3/30
10,767,376 B2 9/2020 Bendall et al.
11,008,763 B2 5/2021 Bendall et al.
11,512,480 B1 * 11/2022 Achor ..... H02S 20/23
2006/0059858 A1 3/2006 Layman
2007/0034449 A1 2/2007 Leendertse
2007/0062761 A1 * 3/2007 Megna ..... E04G 3/26 182/45
2007/0125007 A1 6/2007 Alarcon
2008/0105489 A1 * 5/2008 Garrett ..... E04G 3/26 248/237
2009/0249740 A1 * 10/2009 Crookston ..... E04D 15/02 52/749.12
2010/0213005 A1 8/2010 Sistonen et al.
2010/0252706 A1 10/2010 Hargis
2011/0253193 A1 10/2011 Korman et al.
2011/0314769 A1 12/2011 Foster, Sr. et al.
2011/0315478 A1 12/2011 Foster, Sr. et al.
2013/0240295 A1 9/2013 Wallace
2013/0240699 A1 9/2013 Dillinger et al.
2014/0090316 A1 * 4/2014 Vaidyanathan ..... F24S 25/65 52/173.3
2015/0101996 A1 4/2015 Nayar
2018/0087808 A1 3/2018 Wehrli
2019/0218800 A1 7/2019 Bendall
2020/0399910 A1 * 12/2020 Bendall ..... E04G 5/003
2021/0017778 A1 * 1/2021 Albert ..... E04G 5/041
2021/0348403 A1 * 11/2021 Collister ..... E04G 3/265
2022/0056714 A1 * 2/2022 Kain ..... E04G 3/26
2022/0381034 A1 * 12/2022 Smith ..... E04D 15/07
2025/0305310 A1 * 10/2025 Carroccia ..... E04G 21/329

FOREIGN PATENT DOCUMENTS

CH 712536 A2 12/2017
DE 3317420 A1 * 11/1984 ..... E04G 3/26
DE 3632735 A1 3/1988
DE 9315852 U1 1/1994
DE 19527392 A1 * 1/1997 ..... E04G 3/26
DE 10050493 A1 * 8/2002 ..... E04G 3/26
EP 1482104 A1 * 12/2004 ..... E04G 3/22
FR 1275506 A * 11/1961 ..... E04G 3/26
FR 2737903 A1 2/1997
GB 550143 A * 12/1942 ..... E04G 3/26
GB 2157755 A 10/1985
GB 2273114 A 6/1994
GB 2342380 A 4/2000
SE 529969 C2 * 1/2008 ..... E04G 21/3204
WO 2013175035 A1 11/2013

* cited by examiner

APPARATUS FOR PLACEMENT OF MATERIALS ON A ROOF

CROSS-REFERENCE TO RELATED APPLICATION

This application claims priority to U.S. Patent Application Ser. No. 63/308,856 filed Feb. 10, 2022, the disclosure of which is incorporated herein by reference in its entirety.

FIELD OF THE INVENTION

The present invention relates to apparatus for placing or staging materials on a roof, and, more particularly, on a pitched roof.

BACKGROUND OF THE INVENTION

Various devices have been developed in the past for temporarily placing or staging materials, such as solar panels, roofing materials, etc., on a pitched roof. Such devices facilitate installation of solar panels, roofing materials or the like on a roof, since they allow supply materials to be readily available to installers on the roof. The present invention is directed to improvements for enhancing the flexibility and/or usability of such devices.

SUMMARY OF THE INVENTION

In one embodiment, the present invention includes an apparatus for use in placing supply materials on a roof. In one embodiment, the apparatus includes one or more racks, each of which includes a plurality of rack members. In one embodiment, each of the rack members includes an elongated support member configured to be placed on one side of the roof, as well as an elongated retaining member extending generally upwardly from the support member. In one embodiment, each of the racks includes a connector for removably connecting its corresponding rack members to each other. In one embodiment, each of the racks is placed over a ridge of the roof such that each of the rack members is placed on one side of the roof. In one embodiment, each of the connectors can be removed or detached from the rack members of a corresponding one of the racks and be replaced with a replacement connector having a size different from that of the connector so as to accommodate differently sized supply materials.

In one embodiment, apparatus for placement of materials on a roof having a ridge and first and second sloped sides, which extend downwardly from the ridge, includes at least one rack configured to be placed on the first and second sides of the roof over the ridge for supporting the materials thereon. The at least one rack includes first and second rack members configured to be positioned on the first and second sides, respectively, of the roof. The first and second rack members include first and second support members, respectively, which are configured to be placed on the first and second sides, respectively, of the roof, and first and second retaining members, respectively, which extend from the first and second support members, respectively, for restraining the materials from falling off the first and second rack members, respectively. The at least one rack also includes a flexible connector configured to be placed over the ridge of the roof for removably connecting the first rack member to the second rack member.

In a further embodiment, the apparatus includes another rack configured to be placed on the first and second sides of the roof over the ridge for supporting materials thereon. The another rack includes third and fourth rack members configured to be positioned on the first and second sides, respectively, of the roof. The third and fourth rack members include third and fourth support members, respectively, which are configured to be placed on the first and second sides, respectively, of the roof, and third and fourth retaining members, respectively, which extend from the third and fourth support members, respectively, for restraining the materials from falling off the third and fourth rack members, respectively. The another rack also includes a second flexible connector configured to be placed over the ridge of the roof for removably connecting the third rack member to the fourth rack member.

In one embodiment, a method for placing materials on a roof having a ridge and first and second sloped sides, which extend downwardly from the ridge, includes the step of placing at least one rack on the first and second sides of the roof over the ridge. The at least one rack includes first and second rack members configured to be positioned on the first and second sides, respectively, of the roof. The first and second rack members include first and second support members, respectively, which are placed on the first and second sides, respectively, of the roof, and first and second retaining members, respectively, which extend from the first and second support members, respectively. The at least one rack includes a flexible connector placed over the ridge of the roof and removably connecting the first rack member to the second rack member. The method also includes the step of placing the materials on the first and second rack members of the at least one rack. The first and second retaining members retrain the materials from falling off the first and second rack members, respectively.

BRIEF DESCRIPTION OF THE DRAWINGS

In the drawing figures, which are not to scale, and where like reference numerals indicate like elements throughout the several views.

DESCRIPTION OF EXEMPLARY EMBODIMENTS

Figure 1:
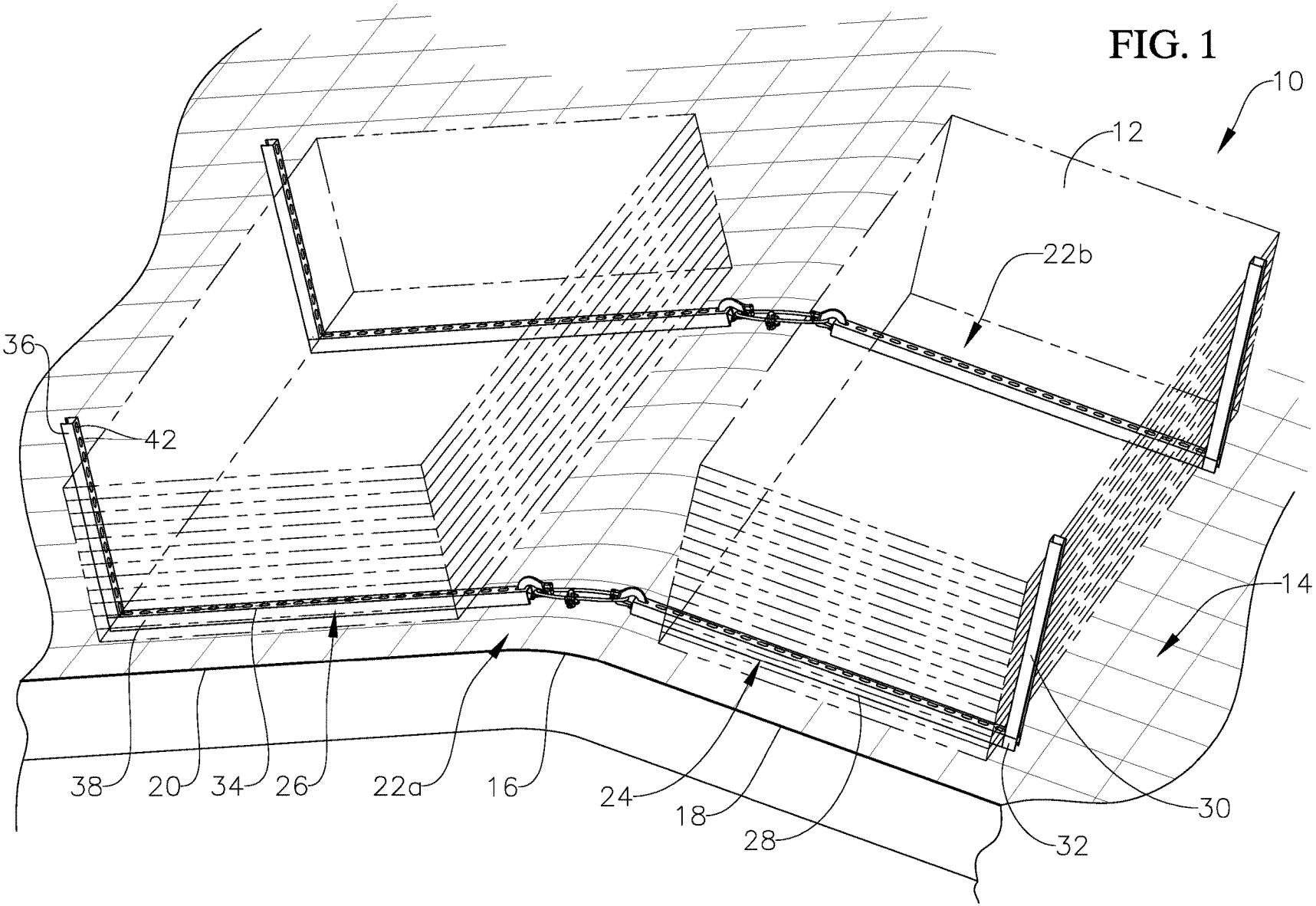
FIG. 1 is a perspective view of an apparatus constructed in accordance with an embodiment.

Embodiments are now discussed in more detail referring to the drawings that accompany the present application. In the accompanying drawings, like and/or corresponding elements are referred to by like reference numbers.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, and some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific examplary embodiments. Subject matter may, however, be embodied in a variety of different forms and, therefore, covered or claimed subject matter is intended to be construed as not being limited to any examplary embodiments set forth herein; exemplary embodiments are provided merely to be illustrative. Among other things, for example, subject matter may be embodied as methods, devices, components, or systems. The following detailed description is, therefore, not intended to be taken in a limiting sense.

Throughout the specification and/or claims, terms may have nuanced meanings suggested or implied in context beyond an explicitly stated meaning. Likewise, the phrase "in one embodiment" as used herein does not necessarily refer to the same embodiment and the phrases "in another embodiment" and "other embodiments" as used herein do not necessarily refer to a different embodiment. It is intended, for example, that covered or claimed subject matter include combinations of exemplary embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

FIG. 1 illustrates an apparatus 10 constructed in accordance with one embodiment for temporarily placing or staging materials 12 (shown in broken line representation) on a roof 14. In one embodiment, the apparatus 10 is configured for holding bundles of solar panels to be installed on the roof 14. In another embodiment, the materials 12 can be other materials, such as bundles of roof singles, roof tiles and the like. The materials 12 are placed on the apparatus 10 so as to be readily available to installers working on the roof 12 to install the materials 12 on the roof 14.

In one embodiment, the apparatus 10 is adapted for placing or staging the materials 12 on a pitched roof 14 with a ridge 16 and a pair of sides 18, 20, slopping downward in opposite directions away from the ridge 16. In one embodiment, the apparatus 10 is configured for use in connection with roofs having varying pitch angles. In one embodiment, the roof 14 can be a tiled roof. In another embodiment, the roof 14 can be a shingled roof. In other embodiments, the apparatus 10 may be used in connection with other types of roof, such as a flat roof.

Still referring to FIG. 1, the apparatus 10 includes a plurality of racks 22*a*, 22*b* in accordance with one embodiment. In one embodiment, two racks 22*a*, 22*b* are used to support the materials 12 on the roof 14. In other embodiments, more than two racks may be utilized depending on the size of the materials 12 to be placed or staged on the roof 14.

In one embodiment, the racks 22*a*, 22*b* have an identical construction. For the sake of brevity, only the construction of the rack 22*a* will be discussed below. It should be understood that the rack 22*b* is constructed and used in the same basic manner as the rack 22*a*.

In one embodiment, the rack 22*a* includes a plurality of rack members 24, 26 configured for placement on the sides 18, 20, respectively, of the roof 14. In one embodiment, the rack member 24 includes a support member 28, which is elongated generally linearly and which is configured to be supported on the side 18 of the roof 14, and a retaining member 30, which extends generally upwardly at an angle from the support member 28 adjacent an end 32 thereof. Similarly, the rack member 26 includes a support member 34, which is elongated generally linearly and which is configured to be supported on the side 20 of the roof 14, and a retaining member 36, which extends generally upwardly at an angle from the support member 34 adjacent an end 38 thereof. In one embodiment, the retaining members 30, 36 project from the support member 28, 34, respectively, approximately at a 90-degree angle. In other embodiments, the retaining members 30, 36 project from the support member 28, 34, respectively, at a different angle in order to perform a retaining function, as discussed in greater detail below.

In one embodiment, the retaining members 30, 36 are fixedly or immovably attached to the support member 28, 34, respectively. For example, the retaining members 30, 36 may be welded to the support member 28, 34, respectively. In other embodiments, the retaining members 30, 36 may be attached to the support member 28, 30, respectively, proximate to, but not at, the ends 32, 38, respectively.

Figure 2:
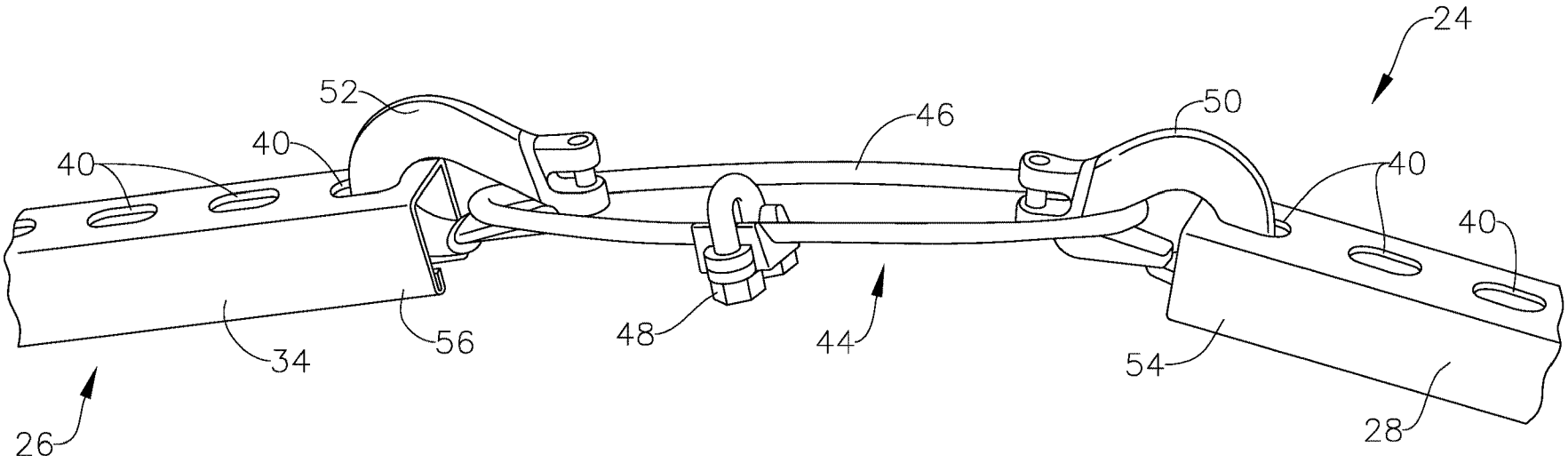
FIG. 2 is an enlarged view of a section of the apparatus shown in FIG. 1.

Now referring to FIG. 2, in one embodiment, each of the support members 28, 34 has an inverted U-shape and includes a plurality of holes 40 arranged substantially along the entire length thereof. Similarly, in one embodiment, each of the retaining members 30, 36 has a U-shape and includes a plurality of holes 42 (see FIG. 1) arranged substantially along the entire length thereof. In other embodiments, the support members 28, 34 and the retaining members 30, 36 may have different constructions and/or shapes. In one embodiment, each of the support members 28, 34 and the retaining members 30, 36 is made from a metallic material, such as steel, copper, or composite metals. In other embodiments, one or more of the support members 28, 34 and the retaining members 30, 36 may be made from another suitable material, such as reinforced fiberglass materials.

Still referring to FIG. 2, in one embodiment, the rack members 24, 26 are connected to each other via a connector 44. In one embodiment, the connector 44 is flexible so as to allow the rack members 24, 26 to pivot or move relative to one another and to thereby allow the rack members 24, 26 to be placed on the sides of 18, 20, respectively, of the roof 14 with the connector 44 placed over the ridge 16. In one embodiment, the connector 44 includes a cable 46 having ends which are secured to each other via a clasp 48 to form a loop. In one embodiment, fasteners 50, 52 are secured to ends 54, 56, respectively, of the support members 28, 34, respectively. In one embodiment, the loop formed by the cable 46 is attached to the fasteners 50, 52. In one embodiment, each of the fasteners 50, 52 is a snap-hook type (e.g., a hook equipped with a spring-loaded closure member) such that the fasteners 50, 52 can be removably secured to the support members 28, 34, respectively. In other embodiments, the fasteners 50, 52 may be other types of fastener for securing the connector 44 to the rack members 24, 26.

In one embodiment, the connector 44 is removably attached to the rack members 24, 26. In this manner, the connector 44 can be removed from the rack members 24, 26 and be replaced with a replacement connector having a different length such that the distance between the rack members 24, 26 can be adjusted (i.e., lengthened or shortened) so as to accommodate differently sized materials for placement on the apparatus 10. In one embodiment, the cable 46 may be fixedly or irremovably attached to the fasteners 50, 52. In this arrangement, the cable 46 is removed from the rack members 24, 26 by unfastening the fasteners 50, 52 from the rack members 24, 26, respectively. In another embodiment, the cable 46 is removably attached to the fasteners 50, 52 such that only the cable 46 is removed, while leaving the fasteners 50, 52 attached to the support member 28, 34, respectively, for use in connection with a replacement cable.

In use, the racks 22*a*, 22*b* are placed on the roof 14 by placing their rack members 24, 26 on the sides 18, 20, respectively, of the roof 14, with the connectors 44 looping over the ridge 16, as illustrated in FIG. 1. The materials 12 are then stacked on the racks 22*a*, 22*b* for staging purposes. More particularly, the materials 12 are supported on the support members 28, 34 of the racks 24, 26, respectively, which in turn are supported on the sides 18, 20, respectively, of the roof 14. The retaining members 30, 36 of the rack members 24, 26 are configured to engage and/or retain the materials 12 so as prevent them from sliding or falling off the rack members 24, 26, respectively. In order to place materials having a different size (e.g., larger materials that do not fit on the rack members 24, 26 connected by the connectors 44), the connectors 44 are detached from the rack members 24, 26 and replaced with replacement connectors having a different size or length so as to accommodate the differently sized materials. In one embodiment, the connectors 44 may be replaced with a longer connector or a shorter connector.

It will be understood that the embodiments described herein are merely exemplary and that a person skilled in the art may make many variations and modifications without departing from the spirit and scope of the invention. All such variations and modifications are intended to be included within the scope of the invention, as defined by the appended claims.

We claim:

1. An apparatus for placement of materials on a roof having a ridge and first and second sloped sides, which extend downwardly from the ridge, said apparatus comprising at least one rack configured to be placed on the first and second sides of the roof over the ridge for supporting the materials thereon, said at least one rack including first and second rack members configured to be positioned on the first and second sides, respectively, of the roof, said first and second rack members including first and second support members, respectively, which are configured to be placed on the first and second sides, respectively, of the roof, and first and second retaining members, respectively, which extend at a 90-degree angle from said first and second support members, respectively, wherein respective inner surfaces of the first and second support members and the first and second retaining members that form the 90-degree angles therebetween are configured to directly contact the materials to restrain the materials from falling off said first and second rack members, respectively, said at least one rack including a flexible connector configured to be placed over the ridge of the roof for removably connecting said first rack member to said second rack member, wherein said flexible connector is configured to be removably attached to said first rack member and/or said second rack member, wherein said flexible connector includes first and second fasteners and a cable connecting said first and second fasteners to one another, said first and second fasteners being configured to be removably fastened to the first and second support members, respectively, wherein each of said first and second support members includes a plurality of holes arranged along a length of a corresponding one of said first and second support members, and wherein each of said first and second fasteners is configured to be removably fastened to one of said holes of a corresponding one of said first and second support members.

2. The apparatus of claim 1, wherein said flexible connector includes a clasp, said cable including ends which are attached to each other by said clasp to form a loop, said first and second fasteners being removably attached to said loop.

3. The apparatus of claim 2, further comprising another rack configured to be placed on the first and second sides of the roof over the ridge for supporting the materials thereon, said another rack including third and fourth rack members configured to be positioned on the first and second sides, respectively, of the roof, said third and fourth rack members including third and fourth support members, respectively, which are configured to be placed on the first and second sides, respectively, of the roof, and third and fourth retaining members, respectively, which extend from said third and fourth support members, respectively, for restraining the materials from falling off said third and fourth rack members, respectively, said another rack including a second flexible connector configured to be placed over the ridge of the roof for removably connecting said third rack member to said fourth rack member.

4. The apparatus of claim 3, wherein said second flexible connector is configured to be removably attached to said third rack member and/or said fourth rack member.

5. The apparatus of claim 4, wherein said second flexible connector includes third and fourth fasteners and a second cable connecting said third and fourth fasteners to one another, said third and fourth fasteners being configured to be removably fastened to the third and fourth support members, respectively.

6. The apparatus of claim 5, wherein each of said third and fourth support members includes a plurality of holes arranged along a length of a corresponding one of said third and fourth support members.

7. The apparatus of claim 6, wherein each of said third and fourth fasteners is configured to be removably fastened to one of said holes of a corresponding one of said third and fourth support members.

8. The apparatus of claim 7, wherein said second flexible connector includes a second clasp, said second cable including ends which are attached to each other by said second clasp to form a second loop, said third and fourth fasteners being removably attached to said second loop.

9. The apparatus of claim 8, wherein said flexible connector is removably attached to said first and second rack members such that said flexible connector is configured to be replaced with another flexible connector having a length different from that of said flexible connector; and wherein said second flexible connector is removably attached to said third and fourth rack members such that said second flexible connector is configured to be replaced with another connector having a length different from that of said second flexible connector.

10. The apparatus of claim 1, wherein said flexible connector is removably attached to said first and second rack members such that said flexible connector is configured to be replaced with another flexible connector having a length different from that of said flexible connector.

11. A method for placing materials on a roof having a ridge and first and second sloped sides, which extend downwardly from the ridge, said method comprising the steps of placing at least one rack on the first and second sides of the roof over the ridge, the at least one rack including first and second rack members positioned on the first and second sides, respectively, of the roof, the first and second rack members including first and second support members, respectively, which are placed on the first and second sides, respectively, of the roof, and first and second retaining members, respectively, which extend at a 90-degree angle from the first and second support members, respectively, the at least one rack including a flexible connector placed over the ridge of the roof and removably connecting the first rack member to the second rack member; and placing the materials on the first and second rack members of the at least one rack, wherein respective inner surfaces of the first and second support members and the first and second retaining members that form the 90-degree angles therebetween are configured to directly contact the materials to restrain the materials from falling off the first and second rack members, respectively; and selecting the flexible connector for the at least one rack based on a size of the materials.

12. The method of claim 11, wherein the flexible connector is configured to be removably attached to the first rack member and/or the second rack member.

13. The method of claim 12, wherein the flexible connector includes first and second fasteners and a cable connecting the first and second fasteners to one another, the first and second fasteners being configured to be removably fastened to the first and second support members, respectively.

14. The method of claim 13, wherein each of the first and second support members includes a plurality of holes arranged along a length of a corresponding one of the first and second support members; and wherein each of the first and second fasteners is configured to be removably fastened to one of the holes of a corresponding one of the first and second support members.

15. The method of claim 13, wherein the flexible connector includes a clasp, the cable including ends which are attached to each other by the clasp to form a loop, the first and second fasteners being removably attached to the loop.

* * * * *